US006988469B2

(12) United States Patent
Schiestl et al.

(10) Patent No.: US 6,988,469 B2
(45) Date of Patent: Jan. 24, 2006

(54) COMBUSTION-ENGINED SETTING TOOL WITH VOLUMETRIC METERING OF GASEOUS FUEL

(75) Inventors: Ulrich Schiestl, Feldkirch (AT); Ulrich Rosenbaum, Wangs (CH); Hans Gschwend, Buchs (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/738,326

(22) Filed: Dec. 17, 2003

(65) Prior Publication Data

US 2004/0182337 A1 Sep. 23, 2004

(30) Foreign Application Priority Data

Dec. 19, 2002 (DE) ..... 102 59 816

(51) Int. Cl.
*F02B 71/00* (2006.01)

(52) U.S. Cl. ..... 123/46 SC

(58) Field of Classification Search ..... 123/46 SC, 123/46 R; 227/10, 8

See application file for complete search history.

(56) References Cited

U.S. PATENT DOCUMENTS 5,000,128 A * 3/1991 Veldman ..... 123/46 SC
5,213,247 A * 5/1993 Gschwend et al. ..... 227/10
6,016,946 A * 1/2000 Phillips et al. ..... 227/10
6,223,963 B1 * 5/2001 Aparacio, Jr. ..... 227/8
6,655,570 B2 * 12/2003 Shkolnikov et al. ..... 227/10

* cited by examiner

*Primary Examiner*—Henry C. Yuen
*Assistant Examiner*—Hyder Ali
(74) *Attorney, Agent, or Firm*—Abelman, Frayne & Schwab

(57) ABSTRACT

A combustion-engined setting tool for driving in fastening elements includes a combustion chamber (22), a drive piston (8) displaceable in a piston guide (5), which adjoins the combustion chamber, in a setting direction upon combustion of a fuel gas in the combustion chamber (22), a metering chamber (49) for metering a predetermined amount of the fuel gas to the combustion chamber (22), a pressure control valve (53) connected with the metering chamber (49) for adjusting an amount of the fuel gas metered by metering chamber (49), and an ignition device (15) for igniting the fuel gas in the combustion chamber (22).

15 Claims, 2 Drawing Sheets

COMBUSTION-ENGINED SETTING TOOL WITH VOLUMETRIC METERING OF GASEOUS FUEL

BACKGROUND OF THE INVENTION

1. Field of the Invention

The present invention relates to a combustion-engined setting tool for driving in fastening elements such as, e.g., bolts or nails in an object and including a combustion chamber, a guide cylinder adjoining the combustion chamber, a drive piston displaceable in the guide cylinder in a setting direction upon combustion of a fuel gas in the combustion chamber, a metering chamber for metering a predetermined amount of the fuel gas to the combustion chamber, and an ignition device for igniting the fuel gas in the combustion chamber.

2. Description of the Prior Act

Setting tools of the type described above all have a combustion chamber in which a fuel gas is ignited. Upon ignition of the fuel mixture in the combustion chamber, a drive piston is displaced in a guide cylinder that adjoins the combustion chamber as a result of expansion of the ignited fuel mixture in the combustion chamber. With the driven piston, a fastening element, which is located in front of the piston, e.g., a nail, is driven, e.g., in a wall located in front of the setting tool or in another surface.

The fuel, which is stored in a pressure reservoir, after it has been withdrawn from the reservoir and before it is injected into the combustion chamber, should be optimally metered out by an appropriate device to insure that an optimal amount of the fuel/air mixture is fed into the combustion chamber. An optimal amount of fuel/air mixture is necessary to insure optimal combustion of the fuel mixture in the combustion chamber.

For an effective operation of a combustion-engined tool, it is necessary that a drive force for driving the piston, which is generated upon ignition of the fuel/air mixture, be the same for each setting process. Because an available amount of oxygen for each combustion process depends to a great extent on the air pressure and the air humidity, the necessary amount of the oxygen varies greatly with changes in these parameters, up to 40% in an extreme case. In order to compensate these variations, there exist metering devices which insure, to greater or lesser degree, a uniform power output of a setting tool.

There exist many methods and metering devices which provide a uniform metering. At a volumetric metering of liquid or liquefied fuels when a fixed metered volume is produced, first, the fluid fuel is fed into a metering valve in which a predetermined to-be-metered volume is preset. With an appropriate actuation device, the fluid fuel contained in the metering valve is fed into a combustion chamber. A drawback of this method consists in that the preset to-be-metered volume of the metering valve is fixed, which does not permit to vary the metered amount of fuel. Therefore, the fuel amount cannot be adapted to variable environmental conditions or operating conditions. Thus, a larger amount of fuel cannot be delivered at low environmental temperatures. Likewise, a smaller amount of fuel cannot be delivered at high temperatures. The set volume of the metering valve can be only determined as a compromise between extreme values and the environmental temperatures and, as a result, an optimal combustion cannot be achieved either at low temperatures or at high temperatures. Further, no power output control of a power tool is possible by varying the amount of fuel.

A volumetric metering with a preset volume is also used for metering of gaseous fuels. With this method, the fuel, after it is withdrawn from the reservoir, is evaporated. The metered-out volume at a gaseous metering is about from 100 to 300 times greater than at a fluid metering. Here, likewise, a fixed metered-out volume is a drawback. The fuel is evaporated before it is fed into a metering chamber by throttling. The necessary evaporation heat is communicated to an evaporator in which the liquid fuel is evaporated before it is fed into the metering chamber. The pressure in the metering chamber is always commensurated with the environmental pressure by providing the metering chamber with a bleed opening open into the environment. In this way, the change in the environmental pressure is compensated. Because a gaseous fuel is fed into the metering chamber, the density of the fuel varies, within certain limits, proportionally to the air density. Thus, the fuel amount is automatically changes with variations in the environmental temperature and is automatically adapted to the environmental pressure. However, in this case, a necessary pre-condition consists in that the temperature in the metering chamber and the air temperature be substantially the same. With a hot tool, this is rarely the case. With this method also, a power output control or the compensation of other environmental conditions, e.g., air humidity, is not possible. The control of pressure in the metering chamber is not contemplated.

Also known are metering methods with which opening of metering valve, e.g., a magnetic valve, is time-controlled. With these methods, by using an electronically controlled magnetic valve, an injected amount of a fluid fuel is measured and the metering valve remains open for a predetermined time period for feeding a desired amount of fuel into the metering chamber. By time-controlling the metering valve, other parameters, which influence the fuel amount or fuel volume, can be taken into account.

A system of the type described above is disclosed in U.S. Pat. No. 6,223,963. The patent discloses a power tool in which a fuel injection circuit controls a time period within which the inlet side of the metering valve remains open. A microprocessor controls the filling period dependent on the time period, gas temperature, temperature in the combustion chamber, and the battery voltage. At an increased temperature, the filling period is reduced, and at a lower temperature, the filling period is increased. The control circuit controls the time of opening of the metering valve dependent on the environmental temperature and/or the environmental pressure.

When metering with a time-control of the opening of the magnetic valve is used for metering of fluid fuels, the fluid is initially fed to the combustion chamber in a fluid or liquid form. This means that the fuel should be evaporated either in its path from the metering device to the combustion chamber or in the combustion chamber. In particular, at cold environmental temperatures, with a lower vapor pressure and an extended evaporation, there is a danger that by the time ignition is effected too little fuel would evaporate, which reduces the power output or, basically, no ignition takes place. Also, at rapid setting processes, there is a danger that too little fuel has evaporated, the power output is reduced, and no ignition takes place.

Accordingly, an object of the present invention is a combustion-engined tool in which a uniform amount of fuel is metered in the metering chamber under changing environmental conditions.

SUMMARY OF THE INVENTION

This and other objects of the present invention, which will become apparent hereinafter, are achieved by providing a pressure control valve which is connected with the metering chamber and with which an amount of fuel metered-out by the metering chamber is adjusted. With this valve, the advantages of both the volumetric metering and the gaseous metering are combined.

To be able to control the metered-out amount of fuel from the metering chamber by controlling the pressure therein, the amount of fuel fed to the metering valve should be large enough to insure adjustment to an optimal value dependent on the environmental pressure and/or measured temperature.

The amount of fuel gas in the metering chamber is fed through an outlet channel of the metered chamber to the combustion chamber when the power tool is pressed against an object. Through the same outlet channel, air, in particular, fresh air is fed. The pressure in the combustion chamber is controlled by adjusting the pressure control valve. The present invention also provides for a power-controlling feeding of the gas mixture. Thus, when an increased drive force is required, it is obtained by increase of the fuel gas portion in the gas mixture.

According to an advantageous embodiment of the present invention, the pressure control valve includes a servo component with which the valve is adjusted.

According to the present invention, the servo component adjusts the pressure control valve dependent on a measured temperature, e.g., of the combustion chamber, or of the metering chamber, and/or of the environment, and/or dependent on the environmental pressure. Dependent on its structure, the pressure control valve can be adjusted in accordance with one or several parameters. This insures an exact metering of the fuel amount in the metering device, e.g., an amount of oxygen, which is enclosed in the combustion chamber, depends on the temperature therein. When the combustion chamber temperature is known, the amount of oxygen therein can be determined which permits to determine how much fuel should be fed into the combustion chamber to obtain a stoichiometric mixture necessary for an optimal combustion. This permits to precisely adjust the amount of fuel gas to be stored in the metering chamber.

By measuring a corresponding parameter(s), the fuel amount can be determined in accordance with a following equation:

Amount of fuel=(metering chamber pressure*metering chamber volume/gas constant*metering chamber temperature)

The present invention permits to better handle the following circumstances. With a non-adjustable pressure control valve, at a high environmental pressure, a larger amount of fuel gas would remain the metering chamber then at a lower environmental pressure. This is because at a lower environmental pressure, the pressure control valve will open more rapidly, and the gas in the metering chamber can, at least partially escape. Because the environmental pressure depends on or is associated with the environmental temperature, the measurement of the environmental temperature permits to conclude what the environmental pressure is and to adjust the pressure at which the pressure control valve would open.

According to further embodiment of the present invention, the servo component of the pressure control valve is electronically controlled by the control signal.

According to the invention, it is possible to automatically compensate the fuel gas density dependent on the foregoing parameters. The gaseous metering permits to avoid any problem associated with an extended evaporation and which can arise when a fluid fuel is injected into a combustion chamber at cold environmental conditions. Moreover, with a gaseous metering, the metered-out volume is much greater and, as a result, the manufacturing tolerances and the thermal expansion of the housing do not influence the metered-out amount in the metering device. Also, other problems are eliminated by effecting evaporation of the fuel in the metering device itself. Further, by the adjustment of the pressure control valve, a control of power of the tool, which would take into consideration environmental conditions, e.g., air humidity, besides the pressure and temperature, is possible.

The novel features of the present invention, which are considered as characteristics for the invention, are set forth in the appended claims. The invention itself, however both as to its construction and its mode operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
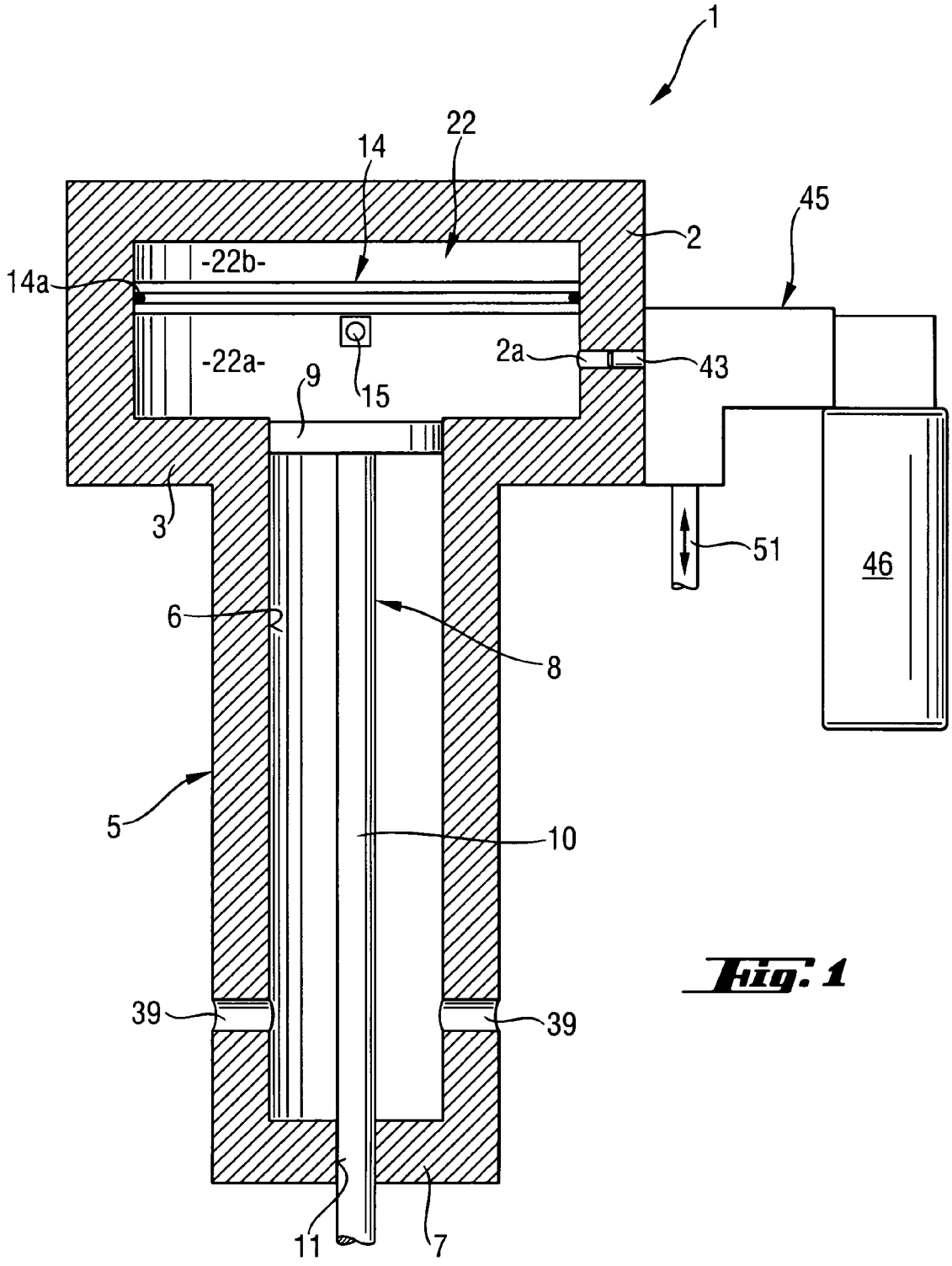
FIG. 1 an axial cross-sectional view of a combustion-engined setting tool according to the present invention with an expended combustion chamber.

FIG. 1 shows an axial cross-sectional view of the inventive combustion-engined setting tool 1 for driving in fastening elements in the region of the tool combustion chamber 22. The cylindrical combustion chamber 22 has a cylindrical wall 2 and a bottom wall 3 that adjoins the cylindrical wall 2. In the center of the bottom wall 3, there is provided an opening which a guide cylinder 5 adjoins. The guide cylinder 5 has a cylindrical wall 6 and a bottom wall 7. A drive piston 8 is displaceably arranged in the guide cylinder 5. The piston 8 is formed of a piston plate 9 facing the combustion chamber 22 and piston rod 10 which extends through an opening 11 formed in the bottom wall 7 of the guide cylinder 5, projecting partially past the bottom wall 7.

In FIG. 1, the piston 8 is located in its rear or initial position that correspond to a non-operating position of the setting tool. Within the combustion chamber 22, there is arrange a cylindrical plate that will be referred to further as a displaceable wall 14. The wall 14 is displaceable in a longitudinal direction of the combustion chamber 22 and is provided at its circumference with a seal 14*a* for sealing sub-chambers 22*a* and 22*b* in front of and behind the displaceable wall 14, respectively. During the expansion of the combustion chamber 22 the wall 14 is displaced in a longitudinal direction of the combustion chamber 14 with drive rods (not shown). During the expansion of the combustion chamber 22, the wall 14 is displaced away from the bottom wall 3 of the combustion chamber 22. At the lower end of the guide cylinder 5, there are provided outlet openings 39 for venting air and/or exhaust gases from the guide cylinder 5 when the piston 8 is displaced toward the guide cylinder bottom wall 7. As soon as the piston 8 passes the outlet openings 39, the air and/or exhaust gases can escape therethrough.

In the cylindrical wall 2 of the combustion chamber 22, there is provided a radial opening 2*a*. In the radial opening 2*a*, there is arranged a discharge nozzle 43 of a metering device 45 which is shown only schematically in FIG. 1. The metering device 45 delivers a liquefied fuel gas from the pressure reservoir 46 into the combustion chamber 22. The metering device 45 injects, into the combustion chamber 22 through the discharge nozzle 43, a metered amount of the fuel gas when the metering device 45 open by a pressure element 51.

The ignition device 15 is used for generating electrical sparks for effecting ignition of the air-fuel gas mixture in the combustion chamber 22.

Below, the operation of the setting tool 1 will be described in detail with reference to FIG. 1.

In FIG. 1, the combustion chamber 22 is in its expanded condition. The piston 8 is in its rear, initial position. By actuating an actuation lever or a trigger of the setting tool, the displaceable wall 14 is locked in its position. At this time, an optimal amount of the gas mixture fills the combustion chamber 22. Shortly after locking of the displaceable wall 14, the ignition device 15 generates an electrical spark, and the fuel gas-air mixture, which was obtained in the combustion chamber 22 by metering an appropriate amount of fuel gas, is ignited. The ignition of the fuel gas-air mixture in the combustion chamber 22 lead to displacement of the piston 8 with high speed in the direction toward the bottom wall 7 of the guide cylinder 5, with the air being forced out through the outlet openings 39. When the piston plate 9 passes past the outlet openings 39, the exhaust gas escapes therethrough. The displaceable, with high speed, piston rod 10 drives a fastening element in a constructional component or other object. After the completion of the setting process or after completion of combustion of the air-fuel gas mixture, the piston 8 is brought to its initial position shown in FIG. 1 as a result of thermal retraction which is produced by cooling of the exhaust gases that remain in the combustion chamber 22 and the guide cylinder 5 and that leads to underpressure behind the piston 8. The combustion chamber 22 should remain closed until the piston 8 reaches its initial position shown in FIG. 1.

Figure 2:
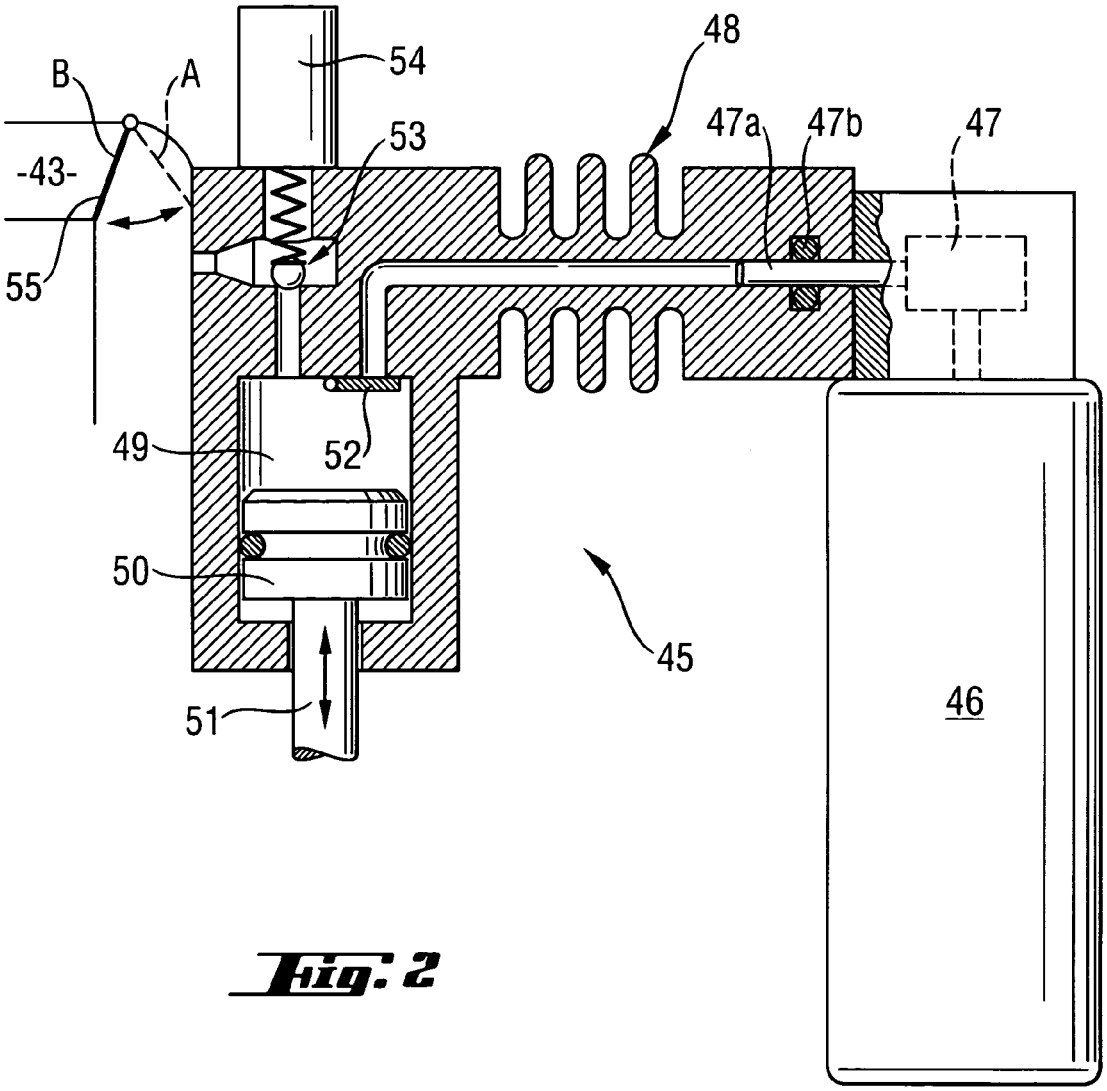
FIG. 2 a cross-sectional view of a metering device for the power tool shown in FIG. 1, together with the pressure reservoir.

FIG. 2 shows the metering device 45, together with the pressure reservoir 46 in which liquefied gas is stored. A metering valve 47 and a conduit 47*a*, which is sealed with a seal 47*b*, connect the pressure reservoir 46 with the metering device 45. An evaporator 48 adjoins the metering valve 47. The liquefied fuel gas is evaporated in the evaporator 48. The fuel gas flows into the metering chamber 49 through a check valve 52, which prevents flow of the fuel gas from the metering chamber 49 back to the evaporator 48. The metering chamber 49 has a piston 50 which is actuated by a press-on element 51. A pressure controlled valve 53, which is adjusted by a servo component 54, adjoins the metering chamber 49. The pressure control valve 53 connects the metering chamber 49 with the discharge nozzle 43.

The metering valve 47 is used for a preliminary metering of the liquefied fuel gas. The amount of the fuel gas, which is metered by the metering valve 47, is somewhat greater than the maximum amount necessary for combustion. In the initial position of a setting tool, i.e., when the setting tool is not yet pressed against an object into which a fastening element is to be driven, the metering valve 47 is open, and the metered, to the evaporator 48, liquefied fuel gas is able to expand in the evaporator chamber. After expanding, the fuel gas flows through the check valve 52 into the metering chamber 49. As soon as the gas pressure in the metering chamber 49 exceeds a predetermined threshold, the excess gas flows out through the pressure control valve 53. Thereby, an excess amount of gas, which was metered by the metering valve 47, is vented through the pressure control valve 53. As soon as a predetermined pressure in the metering chamber 49 is attained, the pressure control valve 53 closes. In this way, by the time the metering chamber 49 is closed, the pressure control valve 53, which is adjusted dependent on the environmental pressure and/or temperature, is capable to meter an optimal amount of the fuel gas remaining in the metering chamber 49.

When the setting tool is pressed against the object the fastening element is driven in, the metering valve 47 is closed with the press-on element 51, with the pressure in the metering chamber 49 increasing due to displacement of the piston 50, and the fuel gas, which remained in the metering chamber 49, flows through the pressure control valve 53 to the discharge nozzle 43. The passage leading to the discharge nozzle 43 is closed by a flap 55. With the flap 55, upon opening of the pressure control valve 53, the fuel gas that flows out of the metering chamber 49, is either fed to the combustion chamber 22 or is vented into atmosphere to adjust an optimal amount that remains in the metering chamber 49. In the A position of the flap 55; the fuel gas is able to flow to the combustion chamber 22. In the position B, the flow of gas to the combustion chamber 22 is blocked, and the fuel gas is vented into atmosphere.

The flap 55 is brought into the position A when the setting tool is pressed against an object, and the fuel gas, which is forced out of the metering chamber 49 becomes mixed with fresh air of the environment. The resulting air-fuel gas mixture is fed into the combustion chamber 22 where the mixture is ignited. Meanwhile, the closed metering valve 47 is filled anew with the liquefied fuel for the next setting process.

After the setting process, the setting tool is again brought to its initial position in which the metering valve 47 opens again. Upon opening of the metering valve 47, a next preliminary metered amount of the fuel gas is fed to the evaporator 48 and therefrom to the metering chamber 49. With an appropriate pressure control valve 47, the variations of the atmospheric pressure can automatically be compensated. The automatic compensation of the atmospheric pressure can be achieved with constructional measures or by electronic measurements of the temperature in the metering chamber and of the environmental air. The obtained parameters are fed to a control unit (not shown) that communicates a corresponding adjusting signal to the servo component 54 that adjusts the pressure control valve 53 for metering a desired amount of the fuel gas.

Though the present invention was shown and described with references to the preferred embodiment, such is merely illustrative of the present invention and are not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A combustion-engined setting tool, comprising a combustion chamber (22); a guide cylinder (5) adjoining the combustion chamber (22); a drive piston (8) displaceable in the guide cylinder(s) (5) in a setting direction upon combustion of a fuel gas in the combustion chamber (22); a metering chamber (49) for metering a predetermined amount of the fuel gas to the combustion chamber (22); a self-actuated pressure control valve (53) connected with the metering chamber (49) for adjusting an amount of the fuel gas that flows from the metering chamber (49) to the combustion chamber (22); and an ignition device (15) for igniting the fuel gas in the combustion chamber (22), wherein the pressure control valve (53) includes a servo component (54) for adjusting pressure in the metering chamber (49).

2. A setting tool according to claim 1, wherein the servo component (54) is controlled dependent on a measured temperature.

3. A setting tool according to claim 2, wherein the servo component (54) is controlled dependent on a temperature in the combustion chamber (22).

4. A setting tool according to claim 2, wherein the servo component (54) is controlled dependent on a temperature in the metering chamber (49).

5. A setting tool according to claim 2, wherein the servo component (54) is controlled dependent on an environmental temperature.

6. A setting tool according to claim 1, wherein the servo component (54) is controlled dependent on an environmental pressure.

7. A setting tool according to claim 1, wherein the servo component (54) is controlled with an electronic control signal.

8. A combustion-engined setting tool, comprising a combustion chamber (22); a guide cylinder(5) adjoining the combustion chamber (22); a drive piston (8) displaceable in the guide cylinder(s) (5) in a setting direction upon combustion of a fuel gas in the combustion chamber (22); a metering chamber (49) for metering a predetermined amount of the fuel gas to the combustion chamber (22); a self-actuated pressure control valve (53) connected with the metering chamber (49) for adjusting an amount of the fuel gas that flows from the metering chamber (49) to the combustion chamber (22); and an ignition device (15) for igniting the fuel gas in the combustion chamber (22), wherein the metering chamber (49) forms part of a metering device (45) also including an evaporator (48) connected with the metering chamber (49), a metering valve (47) for feeding a liquefied fuel gas from a pressure reservoir (46) to the evaporator (48), and a check valve (52) for connecting the evaporator (48) with the metering chamber (49).

9. A setting tool according to claim 8, wherein the pressure control valve (53) includes a servo component (54) for adjusting pressure in the metering chamber (49).

10. A setting tool according to claim 9, wherein the servo component (54) is controlled dependent on a measured temperature.

11. A setting tool according to claim 10, wherein the servo component (54) is controlled dependent on a temperature in the combustion chamber (22).

12. A setting tool according to claim 10, wherein the servo component (54) is controlled dependent on a temperature in the metering chamber (49).

13. A setting tool according to claim 10, wherein the servo component (54) is controlled dependent on an environmental temperature.

14. A setting tool according to claim 9, wherein the servo component (54) is controlled dependent on an environmental pressure.

15. A setting tool according to claim 9, wherein the servo component (54) is controlled with an electronic control signal.

* * * * *